United States Patent [19]

Deane et al.

[11] 4,035,280

[45] July 12, 1977

[54] CONTACT BAR FOR ELECTROLYTIC CELLS

[75] Inventors: Richard Deane; Ronald N. Honey, both of Rossland; Clifford J. Krauss, Trail, all of Canada

[73] Assignee: Cominco Ltd., Vancouver, Canada

[21] Appl. No.: 633,656

[22] Filed: Nov. 20, 1975

[30] Foreign Application Priority Data

Nov. 28, 1974 Canada .....214884

[51] Int. Cl.[2] ..... C25C 1/00; C25C 7/02

[52] U.S. Cl. ..... 204/267; 204/286; 204/297 R

[58] Field of Search ..... 308/215; 193/35, 37; 198/183; 204/267, 286, 288, 297 R

[56] References Cited

U.S. PATENT DOCUMENTS

| | | | |
|---|---|---|---|
| 188,476 | 3/1877 | McGann | 198/127 R |
| 1,791,166 | 2/1931 | Kathner | 198/127 R |

FOREIGN PATENT DOCUMENTS

| | | | |
|---|---|---|---|
| 37-14201 | 9/1962 | Japan | 204/267 |

*Primary Examiner*—Arthur C. Prescott
*Attorney, Agent, or Firm*—Fleit & Jacobson

[57] ABSTRACT

A contact bar of novel design is provided for use in electrolytic cells of the type which have alternating, equally spaced, anodes and cathodes. The electrodes each have header bars, and each header bar has an extending end portion which is notched on its underside. The contact bars of the invention are useful in such cells when employed in the electrolytic recovery of metals such as copper, cadmium, cobalt, lead, nickel, silver and zinc. The contact bars are generally cyclindrical, and have cylindrical end sections and a spooled central section. The spooled central section is created by forming a plurality of alternately identical grooves with center lines equally spaced along the length of the spooled central section. The sidewalls of the grooves are sloped and form right frusto-conical walls which face one another on opposite sides of the groove. This spool-shaped contact bar provides excellent electrical contact via the notched portion of the header bars, the weight of the electrodes insuring high pressure contact between the notched header bars and points located on the sidewalls of the grooves. The contact which is created may aptly be described as a "sloping-tangent contact".

18 Claims, 4 Drawing Figures

CONTACT BAR FOR ELECTROLYTIC CELLS

BACKGROUND OF THE INVENTION

This invention relates to contact bars for electrolytic cells provided with a spaced series of alternately arranged anodes and cathodes. The contact bars of the invention were particularly developed for use in electrolytic cells for the electrowinning of zinc, but may be used in cells for the electrolytic recovery of other metals in electrowinning or electrorefining processes.

The contact bars of the present invention have utility in processes for the electrolytic recovery of metals such as copper, cadmium, cobalt, lead, nickel, silver and zinc. For example, the contact bars have particular utility in zinc electrowinning processes of the general type described, for example, in expired U.S. Pat. No. 2,443,112, F. A. Morin, issued June 8, 1948. In processes of this type there are banks of electrolytic zinc cells, each cell containing electrolyte. Anode and cathode electrodes are disposed in parallel, equally spaced apart, arrangement in each cell, the anodes and cathodes alternating with one another. The anodes are insoluble in the selected electrolyte and are usually made of lead or silver-lead alloy. The anodes are provided with header bars which span the cell and are formed of an electrically conductive material such as copper. The cathodes are made of aluminum sheet material. Such sheet material lends itself to facile stripping of the zinc which is deposited at the cathodes. The cathodes are also provided with header bars formed of a conductive metal, usually aluminum.

In the apparatus in which the contact bars of this invention are intended to be used, the header bars, in the case of all the electrodes, extend outwardly on each side of the electrodes which they are intended to gravitationally support; and one of the extending portions on each header bar is provided on its underside with a notch in the form of an inverted V.

The contact bars of the invention support the electrodes and provide good electrical contact between the header bars and the contact bars, i.e., provide an intimate metal-to-metal contact so that a minimum of electrical resistance is offered to the passage of electric current between the contact bars and the notched portions of the header bars.

Our novel contact bar, which is of generally cylindrical configuration and has a spooled central section, provides for sloping-tangent contacts between (1) the grooves which form the spools and (2) the notches formed in the electrode header bars. The spools are created by cutting equally spaced grooves in the generally cylindrical contact bar. When the notches in the header bars are positioned in the grooves between the spools in the contact bar, the weight of the electrodes creates high pressure, sloping-tangent contacts, resulting in excellent transfer of electrical current between the header and contact bars.

SUMMARY OF THE INVENTION

Our invention will now be generally defined. The contact bar of the invention is generally cylindrical throughout its length and is formed of electrically conductive metal. The end sections of each bar are solid cylinders and the central section is spooled. The spooled central section of the contact bar is created by the cutting of a plurality of grooves which are equally spaced from one another. These grooves are either identical, or alternately identical, along the length of the central section and are spaced from each other by cylindrical bar sections. Each individual groove has a cylindrical middle portion which is of substantially smaller diameter than the cylindrical end sections of the bar. The middle portion of the grooves should be narrower than the width of the electrode header bars in the regions where they are notched. The grooves have sloping sidewalls facing one another on opposite sides of the cylindrical middle portion thereof. The grooves create spools which are of a cylindrical shape and have right frusto-conical sidewalls.

BRIEF DESCRIPTION OF THE DRAWINGS

In the appended drawings, which illustrate a preferred contact bar and show the use of such bars in cells for the electrowinning of zinc.

DESCRIPTION OF THE PREFERRED EMBODIMENT

Figure 1:
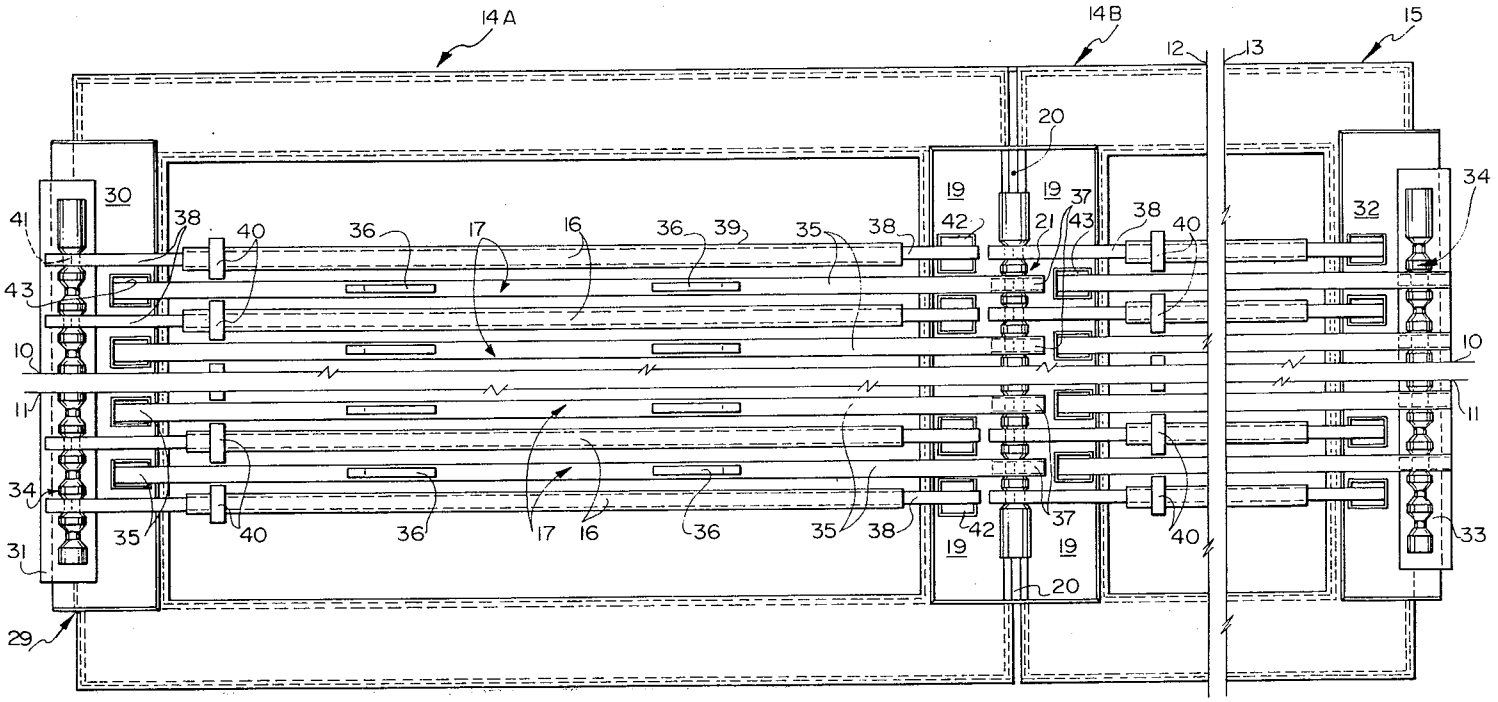
FIG. 1 is a plan view of a portion of a bank of cells wherein the novel contact bars of the invention are employed.

FIG. 1, since it is a plan view of a bank of electrolytic cells employing the contact bars of the invention, merely shows two cells at one end of the bank of cells and part of one cell at the other end of the bank. To show all the cells of the bank would be unduly repetitious. The illustrated cells have been broken longitudinally of the bank, as indicated by the break lines 10 and 11, again to avoid repetition. The bank of cells has also been broken transversely of the bank, as indicated by the break lines 12 and 13. The two cells at the left of FIG. 1 have been labelled 14A and 14B, whilst the end cell on the right has been labelled 15. Thus, cells 14A and 15 are the two end cells. All the intervening cells in the bank will resemble cell 14B. In these cells the electrodes labelled 16 are anodes, the cathodes being labelled 17.

All cells are of conventional rectangular design. Insulators 19, of a generally rectangular formation, are mounted on each adjacent pair of cells so that each insulator straddles the adjacent cell walls. A groove 20 is provided in each insulator 19 with a view to locating the contact bar of the invention with its longitudinal axis disposed equidistantly between the parallelly disposed sidewalls of the cells. One such contact bar is shown in FIG. 1 and labelled 21.

Figure 2:
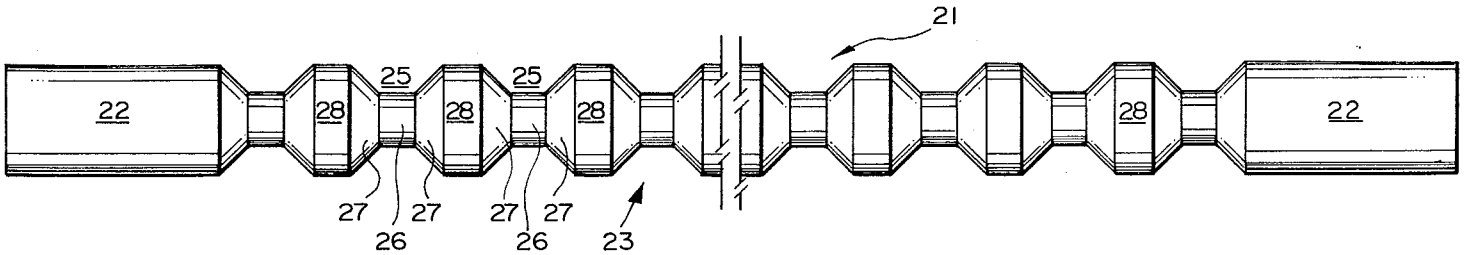
FIG. 2 is a plan view of one of our novel contact bars.

Turning now to FIG. 2, where a contact bar 21 is illustrated on a more generous scale, it will be noted that the contact bar has two cylindrical end sections 22 and central spooled section which has been generally indicated as 23. Central spooled section 23 has been formed by cutting grooves 25 at regularly spaced intervals. Each groove 25 has a cylindrical middle portion 26 and two sloping wall portions 27. The sloping wall portions 27 are of truncated right frusto-conical formation. The grooves are spaced from each other by cylindrical bar sections 28. The cylindrical middle portions 26, together with the sloping wall portions 27, constitute symmetrically shaped spools, separated from one another by the cylindrical bar sections 28, over the length of spooled section 23.

The corners formed between sloping wall portions 27 and bar sections 28 may be sightly rounded to facilitate the insertion of electrodes in the cell.

The length of the cylindrical middle portions 26 of the grooves 25 is determined by the width of the electrode header bars, while the length of the cylindrical bar sections 28 is determined by the distance required between the electrodes in the cell. The diameter of the middle portions 26 of the grooves 25 should be sufficiently large to carry the required current. The depth of the grooves 25 should be such that the tangential contact between the header bars and the contact bar is made approximately at the mid-point of the sloping wall portions 27. These dimensions may vary depending on the requirements of the particular metal being recovered. For example, in the electrowinning of zinc, the length of the cylindrical bar section 28 is of approximately the same length as the middle portion 26 of each groove 25, the slope of the walls of the groove, i.e. the slope of the portions 27, is preferably 45° and the diameter of the middle portion 26 of each groove 25 is from about one-third to three quarters, and is preferably one half of the diameter of the cylindrical end sections 22. The contact bar must of course be made of a metal which is a good conductor of electricity. We prefer to make our contact bars of copper.

In end cell 14A there is disposed, along the outer end wall 29, an anode end cell insulator 30. Also located along the outer wall 29 is a contact plate 31, also made of copper. This contact plate 31, whichforms no part of the invention, is connected in conventional fashion to a bus bar which supplies the electrical power to the cell. The end cell 15, at the right hand side of FIG. 1, is provided with a cathode end cell insulator 32, and there is also provided a contact plate 33 for establishing contact with the bus bar located at this end of the bank of cells.

Figure 3:
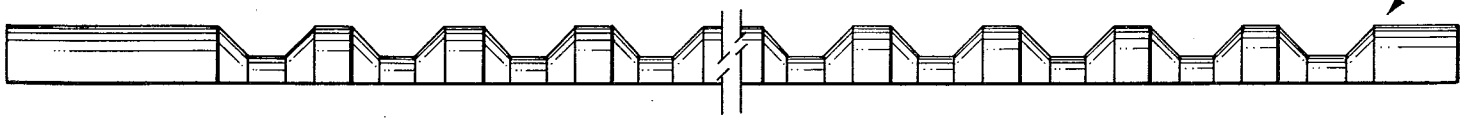
FIG. 3 is a side elevation of a special contact bar intended for use in the end cells of the series.

Special contact bars 34 of semi-cylindrical configuration are employed to establish contact with the plates 31 and 33. These special contact bars 34, one of which is illustrated in FIG. 3, are created by longitudinally sectioning one of the contact bars 21 of the invention. The flat faces of the bars 34 (i.e. the faces formed by cutting one of the bars 21) are intended to be placed, flat-face-down, on and bonded to contact plates 31 and 33 associated with the end cells of the bank.

If so desired, contact bars 21 and 34 may be made in one piece or in two or more sections which are interlocking according to any of a number of well known principles.

In the electrowinning of zinc, each cathode 17 comprises an aluminum header bar 35 of rectangular cross section having two lifting lugs 36 welded to its top and an aluminum cathode sheet welded to its bottom. The cathode sheets are, of course, intended to dip into the electrolyte in the cell. (These cathode sheets, being directly below the header bars 35, cannot be seen in FIG. 1, it being a plan view). Each header bar 35 extends outwardly beyond the cathode sheet on each side thereof to provide means for gravitationally supporting the cathode 17.

Figure 4:
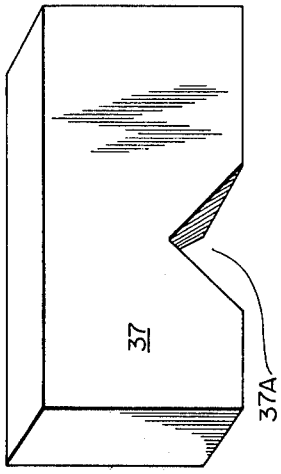
FIG. 4 is a perspective view of an end header piece intended to be rigidly secured to one end of each cathode header bar.

A copper contact piece 37, shown in detail in FIG. 4 of the drawings, is welded onto one end of each cathode header bar 35. These contact pieces 37 will be found, so far as FIG. 1 is concerned, at the right hand ends of the illustrated cathodes 17. Each contact piece 37 is provided on its underside with an inverted V-shaped notch 37A having sides which preferably slope at an angle of approximately 45° to the longitudinal axis of the cathode header bar (and of the contact piece 37 welded thereto). The contact piece 37 should have a width which is greater than the width of the cylindrical middle portion 26 of groove 25 of the contact bar.

While we prefer to use a V-shaped notch 37A wherein both walls are at an angle of 45° to the longitudinal axis of the header bar and its associated contact piece 37, thus giving a preferred included angle in the notch of 90°, the included angle may be as low as 75° and as high as 105°. An included angle of over 105° tends to permit undesirable movement of the electrodes relative to the contact bars, whereas an included angle of less than 75° is disadvantageous in that it may result in jamming of the electrode header bars with respect to the contact bars. The copper contact pieces 37 are preferably silver-plated prior to being welded to the aluminum header bars 35. The copper contact pieces 37 should have a mass which is sufficient to carry the full current without heating up, and a sufficient amount of weld material should be employed in the junction between each copper contact piece 37 and its associated cathode header bar 35 to prevent generation of heat at the currents for which the cell is designed.

In the electrowinning of zinc, each anode 16 comprises a copper header bar 38 which extends beyond each side of a silver-lead alloy anode sheet which is welded to the base of the copper header bar 38. (These anode sheets do not appear in FIG. 1 since it is a plan view and they are directly below the central portions of the header bars 38). The header bars 38 are each provided with a sheath of antimonial lead, and the anode sheets are actually welded to this sheath rather than being welded directly to the copper header bars 38. The anode sheets are preferably formed of silver-lead alloy, and may be slightly tapered from their tops towards their bottoms. The anode header bars 38 are preferably provided with spacers, as indicated at 40, which serve to maintain the desired parallel spaced apart alternating relationship between the anodes 16 and the cathodes 17. The extending end portions of the anode header bars 38 are provided with V-shaped notches at point 41 in one end of each such header bar, the notches 41 being of the same shape and having the same included angle as the inverted V-shaped notches 37A in the copper contact pieces 37.

The configuration and materials of construction of the electodes and parts thereof do not form a part of this invention. It will be understood that the electrodes employed may vary in general configuration and materials of construction so that they are suitable for the electrolytic recovery of metals such as copper, cadmium, cobalt, lead, nickel, silver and zinc. The only essential identical feature of the electrodes is the inverted V notch in the one end of the electrode header bar.

Referring now particularly to the cell 14A, it will be noted that the V-shaped notches 41 in the underside of the anode header bars 38 are disposed in every second groove in semi-cylindrical contact bar 34. The opposite ends of each anode header bar rests upon an insulation pad 42 associated with the insulator 19 at the opposite side of the cell.

In the case of the cathode header bars 35 in cell 14A, one end rests on an insulation pad 43 associated with insulator 30 at the outer side of the cell, whilst the other hand, i.e. the end with the copper contact piece 37 having the V-shaped notch 37A, rests in one of the grooves 25 in the cylindrical contact bar 21 at the right hand side of the cell. The contact pieces 37 of the cathodes in cell 14A occupy alternate grooves in cylindrical contact bar 21 located between cells 14A and 14B. The other grooves are occupied by the notched extremities of the anode header bars 38 of the anodes 17 in cell 14B. A cylindrical contact bar 21 would be arranged in similar fashion between each adjacent pair of cells. At the outermost wall of the final cell 14 there would of course, as already indicated, be another semi-cylindrical contact bar 34. Only half of the grooves of this bar 34 would be utilized, and these grooves would have inserted in them the V-shaped notches 37A of the contact pieces 37 at the right hand end (as viewed in FIG. 1) of the cathode header bars 35 of cell 15.

While we have shown the grooves 25 in contact bar 21 to be identical throughout the length of the bar, they may be only alternately identical. It is sometimes desirable to employ anode header bars which are thicker than the cathode header bars. Where thicker anode header bars are employed, the grooves intended to support such header bars should be wider than those intended to support the cathodes. Therefore, instead of having identical grooves in the contact bar, the contact bar in this case would have a first series of alternately identical, relatively narrow, grooves, and a second series of alternately identical, relatively wide, grooves. In this case the bar will have grooves which may be described as alternately identical with centre lines spaced equally along the length of the spooled central section.

The cross-sectional areas of the contact bars must be sufficient to meet both structural and electrical requirements. In the case of a copper contact bar, a minimum cross-sectional area of about 1 square inch per 1000 Amperes of current is required. This relationship will be different for other metals.

When electrodes are pulled from an operating cell, the current density on the remaining electrodes in the cell, and, consequently, the current flowing through portions of the contact bar between the electrodes remaining in adjacent grooves, increases. It is therefore necessary that the cross-sectional area of the contact bar be sufficient to carry the increased current. If the cross-sectional area is too small, undesirable effects, such as warping or overheating, may occur.

The maximum current flow through the contact bar, or a portion thereof, occurs when the maximum allowable number of electrodes, i.e. cathodes and/or anodes, is removed from a cell, whereby the current carried by the remaining electrodes is also at a maximum. The minimum cross-sectional area of the contact bar, and, specifically that of the cylindrical bar sections 28, must be large enough to allow the flow of a current which is approximately equal to the maximum current load of a single electrode.

For example, if every alternate cathode is pulled from a cell, the current density on the remaining cathodes will double, and the current carried by the contact bar between adjacent anodes which are in contact with that contact bar and a remaining cathode, will also double. Since, in normal electrolytic operations, only half the cathodes, i.e. every alternate cathode, are pulled from one cell at any one time, the minimum cross-sectional area of the cylindrical end sections of the contact bar, and preferably that between the contact points of adjacent electrodes, should be such as to allow a current to flow through the contact bar which is at least approximately equal to the current load of a single anode.

While we do not wish to be bound by our theoretical explanation of the eminently satisfactory results which have been achieved with the contact bars of the invention, we believe the excellent contacts we secure are attributable to the following.

A contact, which can best be described as a "sloping-tangent contract", is established between (a) the V-shaped notches 37A and 41, associated with the cathode and anode assemblies respectively, and (b) the frusto-conical sidewalls 27 of the grooves 25 wherein the V-shaped notches are disposed. There is an extremely high pressure for each contact, the pressure being exerted by the weight of the electrodes. The amount of electric current which can be carried varies directly with the pressure of the contact. Since the electrodes are quite heavy, high pressure is developed at the sloping-tangent contact points between the notches in the electrode assemblies and the sidewalls 27 of the grooves 25. It will be understood that the weight of an electrode assembly generates pressure along tangents to the sloping surfaces 27 which form the sidewalls of grooves 25. Thus, the configuration of the spooled portion of the bars increases the pressure per contact, resulting in an ability to carry high currents without any undesirable voltage drop per contact.

It is an advantage of the invention that the spooled contact bar, when acting in conjunction with the inverted V notches in the electrode header bars, provides positioning and spacing of the header bars and their associated electrodes in three dimensions. Thus, the header bars of the electrodes in the cell are stably positioned in three dimensions.

It is a further advantage of the contact bars of the invention that the sloping-tangent contacts which they create are self-draining, thus preventing build-up of salt deposits at the contact points. Salt deposits should of course be avoided since they may physically prevent the formation of low resistance metal to metal contacts.

The spooled contact bars of the invention have a long useful life since they can be rotated from time to time to create fresh sloping-tangent contact points whenever wear or physical damage interfers with the effectiveness of the contact point which have been employed. Also, of course, in the case of the semi-circular contact bars 34 having identical grooves, since only half their grooves are employed at any given time, their useful life can be doubled by giving them a longitudinal shift over a distance equal to the space between two adjacent grooves.

We have found that the average voltage drop at the contacts is low. For example, in the electrowinning of zinc, the average voltage drop at a cathode contact is 20 millivolts or less at currents up to 1,500 amperes; and that operation at currents as high as 3,000 amperes per contact is feasible with an average voltage drop per contact of 40 millivolts or less. Because of the difference in weight of anodes and cathodes, the voltage drop experienced per contact will be less for the relatively high pressure anode contacts than for the cathode contacts, the anodes being heavier than the cathodes If so desired, parts of the header bars and contact bars may be covered with a protective material, such as, for example, a suitable plastic, paint, rubber, metal or metal alloy, while maintaining metal to metal contacts between the electrode header bars and the contact bars.

We will terminate the disclosure by reporting upon two specific examples showing results achieved utilizing the contact bars of this invention in a process for the electrowinning of zinc.

EXMAPLE1

The following (Table A) illustrates the reduced average voltage per contact of anode and cathode, and the increased current that can be carried per sloping-tangent contact for continuous operation, as compared with contacts conventionally used in the continuous electrowinning of zinc.

Table A

| | Sloping-Tangent Contacts | Conventional Contacts |
|---|---|---|
| Current per contact (A) | 1000–1250 | 700 |
| Average voltage drop per contact at anode (mv) | 5.8 | * |
| Average voltage drop per contact at cathode (mv) | 17 | 40 |

* the conventional anode headed bar is welded to the contact bar.

EXAMPLE 2

The following (Table B) illustrates that the current per sloping-tangent contact, using the contact bars of the invention, can be raised as high as 3000 amperes while maintaining the average voltage drop per contact at values at, or well below, those obtained in conventional processes. The temperature of the electrolyte in the cells was 35° C.

Table B

| | 1 | 2 | 3 | 4 | 5 |
|---|---|---|---|---|---|
| Current per contact (A) | 1000 | 1500 | 2000 | 2500 | 3000 |
| Average voltage drop per contact at anode (mv) | 5 | 7 | 8 | 9 | 10 |
| Average voltage drop per contact at cathode (mv) | 13 | 20 | 27 | 34 | 40 |
| Average operating temperature at contact | | | | | |
| anode (° C) | 36 | 37 | 40 | 47 | 60 |
| cathode (° C) | 37 | 39 | 48 | 60 | 78 |

What we claim as our inventon is:

1. A contact bar formed from copper for use in an electrolytic cell provided with alternating spaced anodes and cathodes, said anodes and cathodes each having a header bar, each header bar having an end extension which is provided on its underside with a notch, said contact bar being constructed to make sloping tangent contact with the notched header bars, said contact bar having a. cylindrical end sections and a spooled central section, b. the latter being created by a plurality of alternately identical grooves with center lines equally spaced along the length of said spooled central section, c. the grooves each comprising a cylindrical middle portion which is of substantially smaller diameter than said cylindrical end section and two oppositely disposed right frusto-conical portions facing one another on the opposite sides of said cylindrical middle portion of each groove.

2. A contact bar as defined in claim 1, wherein each groove is spaced from the next adjacent groove by a cylindrical bar section, each said cylindrical bar section being of substantially the same diameter as said cylindrical end sections.

3. A contact bar as defined in claim 2, wherein the length of each said cylindrical bar section and the length of each said cylindrical middle portion of said grooves are substantialy equal.

4. A contact bar as defined in claim 1, in which each said cylindrical middle portion has a diameter which is substantially half that of the cylindrical end sections of the contact bar.

5. A contact bar as defined in claim 1, in which the angle of the right frusto-conical portions of the grooves, if extended, would form an angle of about 45° with the longitudinal axis of the contact bar.

6. A contact bar as defined in claim 1, in which each said cylindrical middle portion has a diameter which is from about one third to three quarters of the diameter of the cylindrical end sections of the contact bar.

7. A contact bar as defined in claim 1, wherein all said grooves are identical.

8. A contact bar formed of copper and intended for use in an electrolytic cell for the electrowinning of zinc having lead anodes and aluminum cathodes alternating with one another and equally spaced from one another, said anodes and cathodes having electrically conductive header bars whereby they may be gravitationally suspended in the cell, the header bar of each anode and cathode having an end extension provided with an inverted V-shaped notch, a. said contact bar being shaped to provide support for the notched ends of said header bars withsloping tangential, metal-to-metal contact between said header bar and the contact bar, whereby a minimum of electrical resistance is offered to passage of electric current between said header bars and said contact bar, b. said contact bar having cylindrical end sections and a spooled central section, c. the latter being created by a plurality of alternately identical grooves with centre lines equally spaced along the length of said spooled central section, d. the grooves each comprising a cylindrical middle portion which is of substantially smaller diameter than said cylindrical end sections, and two oppositely disposed right frusto-conical portions facing one another on the opposite sides of said cylindrical middle portion of each groove.

9. A contact bar as defined in claim 8, wherein each groove is spaced from the next adjacent groove by a cylindrical bar section, each said cylindrical bar section being of substantially the same diameter as said cylindrical end sections.

10. A contact bar as defined in claim 9, wherein the said cylindrical bar sections and the said cylindrical middle portions of said grooves are substantially equal in length.

11. A contact bar as defined in claim 8, in which each said cylindrical middle portion of the grooves has a diameter which is substantially half of that of the cylindrical end sections of the contact bar.

12. A contact bar as defined in claim 8, in which the right frusto-conical portions of the grooves, if extended, would form an angle of about 45° with the longitudinal axis of the contact bar.

13. A contact bar as defined in claim 8, wherein all grooves are identical .

14. A contact bar as defined in claim 8, in which each cylindrical middle portion has a diameter which is from about one third to three quarters of the diameter of the cylindrical end sections of the contact bar.

15. A cell for the electrolytic recovery of metal which comprises a plurality of alternating, spaced anodes and cathodes, said anodes and cathodes being parallel to one another and extending transversely across said a. said anodes and cathodes having electrically conductive header bars whereby they are gravitationally suspended in the cell on contact bars disposed at right angles to the anodes and cathodes, b. the header bars of each anode and cathode having an end extension provided with an inverted V-shaped notch;

c. said contact bars being shaped to provide support for the notched ends of said anodes and cathodes with tangential, metal-to-metal, contact between said header bars and the contact bars;

d. said contact bars having cylindrical end sections and a spooled central section, e. the latter being created by a plurality of alternately identical grooves with center lines equally spaced from one another along the length of said spooled central section, f. the grooves each comprising a cylindrical middle portion which is of substantially smaller diameter than said cylindrical end sections and is narrower than the width of the notched end extensions of the header bars, and g. two oppositely disposed right frusto-conical portions facing one another on the opposite of said cylindrical middle portion of each groove.

16. A cell as defined in claim 15, in which the contact bars are made of copper.

17. A cell as defined in claim 15, wherein the notches in the header bars have an angle in the range of from about 75° to about 105°.

18. A cell as defined in claim 15, in which the header of the electrodes in the cell are stably positioned in three dimensions.

* * * * *